US006337303B1

(12) United States Patent
Dooms et al.

(10) Patent No.: US 6,337,303 B1
(45) Date of Patent: Jan. 8, 2002

(54) THERMOGRAPHIC RECORDING MATERIALS WITH IMPROVED IMAGE TONE

(75) Inventors: Philip Dooms, Oosteekloo; Peter Michiels, Schilde; Ingrid Geuens, Emblem, all of (BE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/584,634

(22) Filed: May 31, 2000

Related U.S. Application Data

(60) Provisional application No. 60/142,639, filed on Jul. 6, 1999.

(30) Foreign Application Priority Data

Jun. 4, 1999 (EP) ..... 99201792

(51) Int. Cl.[7] ..... B41M 5/26

(52) U.S. Cl. ..... 503/201; 503/202; 503/209; 503/212

(58) Field of Search ..... 503/201, 202, 503/209, 212

(56) References Cited

FOREIGN PATENT DOCUMENTS

| | | |
|---|---|---|
| EP | 782043 | 7/1997 |
| EP | 809142 | 11/1997 |

*Primary Examiner*—Bruce H. Hess
(74) *Attorney, Agent, or Firm*—Leydig, Voit & Mayer, Ltd.

(57) ABSTRACT

A substantially light-insensitive black and white thermographic recording material comprising a thermosensitive element and a support, the thermosensitive element containing at least one substantially light-insensitive organic silver salt, at least one organic reducing agent therefor in thermal working relationship therewith, a binder, at least one stabilizer and optionally an α,(ω-alkyldicarboxylic acid with a straight chain alkyl group having at least 4 carbon atoms which may be substituted, however neither including 3,5-dihydroxybenzoic acid as acidic reagent nor di-tert-butyl-p-cresol as a sole organic reducing agent, wherein the at least one stabilizer is represented by formula (I):

$$R^1—(O{=}C)—R^2—(C{=}O)—R^3 \quad (I)$$

wherein $R^2$ is a divalent straight chain saturated hydrocarbon group with 2 or 3 carbon atoms which may be substituted with one or more of =O, =S, $=CR^4R^5$, an alkyl group, a cycloalkyl group, a hydroxy group, a thiol group, a $—(C{=}O)R^6$ group or two of the substituents of $R^2$ may together form a closed non-aromatic carbocyclic or heterocyclic ring; $R^4$ and $R^5$ are independently hydrogen or an alkyl, hydroxy, thiol, $—(C{=}O)\ R^7$ group or $R^4$ and $R^5$ together may form a closed carbocyclic or heterocyclic group; $R^1$, $R^3$, $R^6$ and $R^7$ are independently a hydroxy or $—NHR^8$ group or $R^1$ and $R^3$ together is an oxygen atom forming an anhydride group; $R^8$ is hydrogen or a hydroxy, alkyl, aryl or $—SO_2R^9$ group; $R^9$ is an alkyl, cycloalkyl, heterocyclic, aryl, heteroaryl, an $—OR^{10}$, or a $—NR^{11}R^{12}$ group; $R^{10}$ and $R^1$ are independently an alkyl, cycloalkyl, or aryl group; $R^{12}$ is hydrogen or an alkyl, cycloalkyl or aryl group; and $R^{11}$ and $R^{12}$ may together form a closed carbocyclic or heterocyclic group; and wherein the concentration of the at least one stablizer and the (α,ω-alkyldicarboxylic acid, if present, is together at least 20 mol % with respect to the organic silver salts; and a recording process therefor.

13 Claims, No Drawings

THERMOGRAPHIC RECORDING MATERIALS WITH IMPROVED IMAGE TONE

The application claims the benefit of U.S. Application No. 60/142,639 filed Jul. 6, 1999.

FIELD OF THE INVENTION

The present invention relates to thermographic recording materials with improved image tone.

BACKGROUND OF THE INVENTION

Thermal imaging or thermography is a recording process wherein images are generated by the use of thermal energy. In direct thermal thermography a visible image pattern is formed by image-wise heating of a recording. On heating to a certain conversion temperature, an irreversible chemical reaction takes place and a coloured image is produced.

U.S. Pat. No. 3,074,809 discloses a heat sensitive copy-sheet useful in providing dense dark-colored image areas of pleasing appearance in the thermographic copying of differentially radiation-absorptive originals, the copy-sheet including a visibly heat-sensitive layer comprising: a normally solid organic silver salt of a noble metal; a cyclic organic reducing agent for the noble metal ions, which reducing agent has an active hydrogen atom attached to an atom, selected from the class of oxygen, nitrogen and carbon atoms, directly attached to an atom of the cyclic ring; and as a third significant component and in significant small amount within the approximate proportions of one to 10 percent of the composition, an organic carboxylic acid toner compound having a carboxyl group and at least one other group, from the class consisting of carboxyl and hydroxyl groups, in position to permit condensation reaction with the carboxyl group and with formation of a heterocyclic ring structure having 5–6 members in the ring.

EP-A 687 572 discloses a direct thermal imaging process wherein a non-photosensitive direct thermal recording material is heated dot-wise, and the direct thermal recording material comprises an imaging layer containing uniformly distributed in a film-forming polymeric binder (i) one or more substantially light-insensitive organic silver salts, the silver salt(s) being uniformly in thermal working relationship with (ii) one or more organic reducing agents therefor, however neither including 3,5-dihydroxybenzoic acid as acidic reagent nor di-tert-butyl-p-cresol as a sole organic reducing agent, wherein the imaging layer contains at least one polycarboxylic acid and/or anhydride thereof in a molar percentage of at least 20 with respect to the silver salt(s).

In printing with thermographic materials for medical applications with viewing with a light box, the materials should exhibit a fairly flat response of image density to heat applied (sensitometry) as provided by the thermographic materials disclosed in EP-A 687 572. However, optimum diagnosis requires a blue-black image tone so that higher ability of the human eye to distinguish detail with such image tone can be exploited, thereby improving the diagnostic value of such prints. A blue-black image tone is often obtained by coating the thermographic material on a support pigmented with a blue pigment, making the intrinsic image tone of thermographic material less critical. However, in the case of thermographic materials coated on a non-pigmented support, the intrinsic image tone of the thermographic material is very important. Image tone can be assessed on the basis of the L*, a* and b* CIELAB-values, the desired blue black image tone corresponding to a b* value<0.

Imaging materials for medical applications are also produced using a support with a particular blue pigment e.g. MACROLEX™ BLUE 3R from BAYER. The colour of such supports can also be defined in terms of L*, a* and b* CIELAB-values. Representative supports used for medical imaging materials have CIELAB-a* values and -b* values given in the table below.

| | a* | b* | Dvis |
|---|---|---|---|
| MEDICAL IMAGING MATERIAL SUPPORT 1 | −7 | −13.82 | 0.172 |
| MEDICAL IMAGING MATERIAL SUPPORT 2 | −7.22 | −13.02 | 0.174 |
| MEDICAL IMAGING MATERIAL SUPPORT 3 | −6.86 | −14.46 | 0.181 |
| MEDICAL IMAGING MATERIAL SUPPORT 4 | −7.92 | −16.62 | 0.195 |

However, the background colour and the colour of an image is a combination of the colour of the support and the colour of the image background and the image of the particular material upon printing and b* values<−8 at D=1.0 are preferred.

OBJECTS OF THE INVENTION

It is therefore an object of the present invention to provide substantially light-insensitive black and white thermographic recording materials using a non-pigmented support capable of producing prints with a blue-black image tone.

It is therefore a second object of the present invention to provide substantially light-insensitive black and white thermographic recording materials whose prints have a higher diagnostic value.

Further objects and advantages of the invention will become apparent from the description hereinafter.

SUMMARY OF THE INVENTION

It has been surprisingly found that thermographic materials containing particular polycarboxylic acids and combinations thereof produce prints with a markedly improved image tone i.e. a blue-black image tone without the need for a support pigmented with a blue pigment. , The above mentioned objects are realized by a substantially light-insensitive black and white thermographic recording material comprising a thermosensitive element and a support, the thermosensitive element containing at least one substantially light-insensitive organic silver salt, at least one organic reducing agent therefor in thermal working relationship therewith, a binder, at least one stabilizer and optionally an α,ω-alkyldicarboxylic acid with a straight chain alkyl group having at least 4 carbon atoms which may be substituted, however neither including 3,5-dihydroxybenzoic acid as acidic reagent nor di-tert-butyl-p-cresol as a sole organic reducing agent, wherein the at least one stabilizer is represented by formula (I):

$$R^1—(O{=}C)—R^2—(C{=}O)—R^3 \quad (I)$$

wherein $R^2$ is a divalent straight chain saturated hydrocarbon group with 2 or 3 carbon atoms which may be substituted with one or more of =O, =S, $=CR^4R^5$, an alkyl group, a cycloalkyl group, a hydroxy group, a thiol group, a $—(C{=}O)R^6$ group or two of the substituents of $R^2$ may together form a closed non-aromatic carbocyclic or heterocyclic ring; $R^4$ and $R^5$ are independently hydrogen or an alkyl, hydroxy, thiol, $—(C{=}O)R^7$ group or $R^4$ and $R^5$ together may form a closed carbocyclic or heterocyclic group; $R^1$, $R^3$, $R^6$ and $R^7$ are independently a hydroxy or $—NHR^8$ group or $R^1$ and $R^3$ together is an oxygen atom forming an anhydride group; $R^8$ is hydrogen or a hydroxy, alkyl, aryl or $—SO_2R^9$ group; $R^9$ is an alkyl, cycloalkyl, heterocyclic, aryl, heteroaryl, an $—OR^{10}$, or a $—NR^{11}R^{12}$ group; $R^{10}$ and $R^{11}$ are independently an alkyl, cycloalkyl or aryl group; $R^{12}$ is hydrogen or an alkyl, cycloalkyl or aryl group; and $R^{11}$ and $R^{12}$ may together form a closed carbocyclic or heterocyclic group; and wherein the concentration of the at least one stablizer and the α,ω-alkyldicarboxylic acid, if present, is together at least 20 mol % with respect to the organic silver salts.

A recording process is also provided by the present invention comprising the steps of: (i) bringing an outermost layer of a thermographic recording material as described above into proximity with a heat source; (ii) applying heat from the heat source imagewise to the thermographic recording material in a substantially water-free condition while maintaining proximity to the heat source to produce an image; and (iii) removing the thermographic recording material from the heat source.

Preferred embodiments of the present invention are disclosed in the dependent claims.

DETAILED DESCRIPTION OF THE INVENTION

In a preferred embodiment of the thermographic recording process, according to the present invention, the heat source is a thermal head with a thin film thermal head being particularly preferred.

DEFINITIONS

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

By substantially light-insensitive is meant not intentionally light sensitive.

The L*, a* and b* CIELAB-values are determined by spectrophotometric measurements according to ASTM Norm E179-90 in a R(45/0) geometry with evaluation according to ASTM Norm E308-90.

a* and b* drift refers to changes in a and b with time after printing and a* and b* shift refers to changes in a* and b* upon changing the line time of the thermographic printer.

Heating in a substantially water-free condition as used herein, means heating at a temperature of 80 to 250° C. The term "substantially water-free condition" means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Stabilizer According to Formula (I)

Formula (I): $R^1—(O{=}C)—R^2—(C{=}O)—R^3$ (I)

wherein $R^2$ is a divalent straight chain saturated hydrocarbon group with 2 or 3 carbon atoms which may be substituted with one or more of =O, =S, $=CR^4R^5$, an alkyl group, a cycloalkyl group, a hydroxy group, a thiol group, a $—(C{=}O)R^6$ group or two of the substituents of $R^2$ may together form a closed non-aromatic carbocyclic or heterocyclic ring; $R^4$ and $R^5$ are independently hydrogen or an alkyl, hydroxy, thiol, $—(C{=}O)R^7$ group or $R^4$ and $R^5$ together may form a closed carbocyclic or heterocyclic group; $R^1$, $R^3$, $R^6$ and $R^7$ are independently a hydroxy or $—NHRA^8$ group or $R^4$ and $R^3$ together is an oxygen atom forming an anhydride group; $R^8$ is hydrogen or a hydroxy, alkyl, aryl or $—SO_2R^9$ group; $R^9$ is an alkyl, cycloalkyl, heterocyclic, aryl, heteroaryl, an $—OR^{10}$, or a $—NR^{11}R^{12}$ group; $R^{10}$ and $R^{11}$ are independently an alkyl, cycloalkyl or aryl group; $R^{12}$ is hydrogen or an alkyl, cycloalkyl or aryl group; and $R^{11}$ and $R^{12}$ may together form a closed carbocyclic or heterocyclic group.

In formula (I), if $R^4$ and $R^5$ are alkyl groups such groups may be substituted with halogen atoms or hydroxy, alkoxy, carboxy, or carboxyalkyl groups. The $R^9$ groups in formula (I) may be substituted with halogen atoms or alkyl, aryl, hydroxy, alkoxy, carboxy, or carboxyalkyl groups. The $R^{10}$ and $R^{11}$ groups in formula (I) may be substituted with halogen atoms or alkyl, aryl, hydroxy, alkoxy, carboxy, or carboxyalkyl groups.

Examples of unsubstituted $R^2$ groups are: $—(CH_2)_2—$; and $—(CH_2)_3—$. Preferred examples of substituted $R^2$ groups are $—CH_2—CH(CH_3)—$; $—CH_2—C(=CH_2)—$; $—CH(CH_3)—CH_2—CH_2—$; $—CH_2—CH(CH_3)—CH_2—$; $—CH_2—CH(OH)—$; $—C(=O)—CH_2—CH_2—$; $—CH_2—C(=O)—CH_2—$; $—CH_2—C(OH)(COOH)—CH_2—$; $—CH_2—CH(COOH)—CH(OH)—$; $—C(CH_3)_2—CH_2—CH_2—$; and $—CH_2—C(CH_3)_2—CH_2—$.

The at least one stabilizer according to formula (I) preferably has a $pKa_1$ in the range of 1.5 to 5. $pKa_1$ values of stabilizers according to formula (I) are given in the table below:

| stabilizer according of formula (I) | $pKa_1$ |
|---|---|
| glutaric acid | 4.31 |
| succinic acid | 4.16 |
| itaconic acid | 3.85 |
| 2-methyl succinic acid | 4.13 |

The at least one stabilizer according to formula (I) is also preferably capable of forming an intramolecular anhydride. Compounds according to formula (I) capable of forming an intramolecular anhydride include: succinic acid; glutaric acid; 2,2-dimethylgeutaric acid; 3,3-dimethylglutaric acid; itaconic acid; and 2-methylsuccinic acid.

Many of the stabilizers of formula (I) are commercially available including all those used in the INVENTION EXAMPLES of the present text. If not commercially available such compounds can be prepared according to standard synthetic techniques known to organic chemists.

Examples of saturated compounds according to formula (I) are: succinic acid, 2-methylsuccinic acid, 1,2-dimethylsuccinic acid, d-malic acid, 1-malic acid, dl-malic acid, glutaric acid, 2,2-dimethyl-glutaric acid, 3,3-dimethylglutaric acid, 1,3-acetonedicarboxylic acid, 2-ketoglutaric acid, 1,1-cyclohexanediacetic acid, cis-1,2-cyclohexanedicarboxylic acid, trans-1,2-cyclohexanedicarboxylic acid, cis-1,3-cyclohexanedicarboxylic acid, trans-1,3-cyclohexanedicarboxylic acid, 1,2,3,4-cyclobutanetetracarboxylic acid, tetrahydrofuran-2,3,4,5-tetracarboxylic acid, camphoric acid; citric acid and isocitric acid. An example of an unsaturated compound according to formula (I) is: itaconic acid.

A preferred stabilizer according to formula(I) is selected from the group consisting of lglutaric acid, succinic acid, 2-methyl succinic acid, 2,2-dimethyl-glutaric acid, 3-methylglutaric acid, tetrahydrofuran-2,3,4,5-tetracarboxylic acid and itaconic acid.

α,ω-alkyldicarboxylic Acid With a Straight Chain Alkyl Group Having at Least 4 Carbon Atoms Which May Be Substituted According to the thermographic recording material of the present invention the thermosensitive element can contain an α,ω-alkyldicarboxylic acid with a straight chain alkyl group having at least 4 carbon atoms which may be substituted. The intramolecular anhydrides of the acids are included in the term α,ω-alkyldicarboxylic acid for the sake of the present invention. The α,ω-alkyldicarboxylic acid is aliphatic (saturated as well as unsaturated aliphatic). These acids may be substituted e.g. with alkyl, hydroxyl, nitro or halogen. They may be used in anhydride form or partially esterified on the condition that at least two free carboxylic acids remain or are available in the heat recording step.

Suitable saturated α,ω-alkyldicarboxylic acids are adipic acid, pimelic acid, suberic acid, azelaic acid, sebacic acid, nonane-dicarboxylic acid, decane-dicarboxylic acid, undecane-dicarboxylic acid, with adipic acid, pimelic acid suberic acid and azelaic acid being particularly suitable.

Thermosensitive Element

The thermosensitive element, according to the present invention, contains at least one substantially light-insensitive organic silver salt, at least one organic reducing agent therefor in thermal working relationship therewith, a binder, at least one stabilizer according to formula (I) and optionally an α,ω-alkyldicarboxylic acid with a straight chain alkyl group having at least 4 carbon atoms which may be substituted. The element may comprise a layer system in which the ingredients may be dispersed in different layers, with the proviso that the substantially light-insensitive organic silver salt is in reactive association with the organic reducing agent i.e. during the thermal development process the organic reducing agent must be present in such a way that it is able to diffuse to the particles of substantially light-insensitive organic silver salt so that reduction to silver can occur.

Organic Silver Salt

Preferred organic silver salts for use in the thermographic recording materials of the present invention are substantially light-insensitive silver salts of an organic carboxylic acid. Preferred substantially light-insensitive silver salts of an organic carboxylic acid are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention, as disclosed in EP-A 964 300.

Organic silver salts may be dispersed by standard dispersion techniques e.g. using ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and a more finely ground dispersions of organic silver salts.

Organic Reducing Agents

Suitable organic reducing agents for the reduction of mixed crystals of two or more organic silver salts are organic compounds containing at least one active hydrogen atom linked to O, N or C, such as is the case with, aromatic di- and tri-hydroxy compounds. 1,2-dihydroxybenzene derivatives, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters are preferred. In particularly preferred substantially light-insensitive thermographic materials according to the present invention the at least one organic reducing agent is described in EP-B 692 733 e.g. ethyl 3,4-dihydroxybenzoate, n-butyl 3,4-dihydroxybenzoate and/or EP-A 903 625 e.g. 3,4-dihydroxybenzonitrile, 3,4-dihydroxyacetophenone and 3,4-dihydroxybenzophenone. In an especially preferred embodiment of the present invention the at least one organic reducing agent comprises 3,4-dihydroxybenzonitrile in a concentration of at least 30 mol % with respect to the substantially light-insensitive organic silver salt.

Combinations of organic reducing agents may also be used that on heating become reactive partners in the reduction of the at least one substantially light-insensitive organic silver salt. For example, combinations of sterically hindered phenols with sulfonyl hydrazisoe reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. Nos. 5,545,505, 5,545,507 and 5,558,983; acrylonitrile compounds as disclosed in U.S. Pat. Nos. 5,545,515 and 5,635,339; and 2-substituted malonodialdehyde compounds as disclosed in U.S. Pat. No. 5,654,130.

Binder of the Thermosensitive Element

The film-forming binder of the thermosensitive element may be all kinds of natural, modified natural or synthetic resins or mixtures of such resins, in which the at least one organic silver salt can be dispersed homogeneously either in aqueous or solvent media: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

Suitable water-soluble film-forming binders for use in thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders such as gelatine, modified gelatines such as phthaloyl gelatine, polysaccharides, such as starch, gum arabic and dextran and water-soluble cellulose derivatives.

The binder to organic silver salt weight ratio is preferably in the range of 0.2 to 7, and the thickness of the thermosensitive element is preferably in the range of 5 to 50 mm. Binders are preferred which do not contain additives, such as certain antioxidants (e.g. 2,6-di-tert-butyl-4-methylphenol), or impurities which adversely affect the thermographic properties of the thermographic recording materials in which they are used.

Toning Agent

In a preferred embodiment of the substantially light insensitive thermographic recording material of the present invention, the thermosensitive element further contains at least one toning agent known from thermography to obtain a neutral black image tone in the higher densities and neutral grey in the lower densities.

Suitable toning agents are those disclosed in U.S. Pat. Nos. 3,074,809, 3,446,648 and 3,844,797 and the phthalimides and phthalazinones within the scope of the general formulae described in U.S. Pat. No. 4,082,901. Other particularly useful toning agents are the heterocyclic toner compounds of the benzoxazine dione or naphthoxazine dione type as disclosed in GB 1,439,478, U.S. Pat. Nos. 3,951,660 and 5,599,647.

In a preferred embodiment of the thermographic recording material according to the present invention, the at least one toning agent is selected from the group consisting of phthalazinone, a phthalazinone derivative, pyridazone, a pyridazone derivative, a benzoxazin derivative and a substituted benzoxazine derivative. It is particularly preferred that the at least one toning agent is selected from the group consisting of benzo[e] [1,3]oxazine-2,4-dione, 7-methylbenzo[e] [1,3]oxazine-2,4-dione (CAS register number 24088-77-5) and 7-(ethylcarbonato)-benzo[e] [1,3]oxazine-2,4-dione.

Antifoggants

Antifoggants may be incorporated into the thermographic recording materials of the present invention in order to obtain improved shelf-life and reduced fogging.

Preferred antifoggants are benzotriazole, substituted benzotriazoles, tetrazoles, mercaptotetrazoles and aromatic polycarboxylic acid such as ortho-phthalic acid, 3-nitrophthalic acid, tetrachlorophthalic acid, mellitic acid, pyromellitic acid and trimellitic acid and anhydrides thereof.

Surfactants and dispersion agents

Surfactants and dispersants aid the dispersion of ingredients or reactants which are insoluble in the particular dispersion medium. The thermographic recording materials of the present invention may contain one or more surfactants, which may be anionic, non-ionic or cationic surfactants and/or one or more dispersants.

Other Additives

The recording material may contain in addition to the ingredients mentioned above other additives such as antistatic agents, e.g. non-ionic antistatic agents including a fluorocarbon group as e.g. in $F_3C(CF_2)_6CONH(CH_2CH_2O)$—H, silicone oil, e.g. BAYSILON™ MA (from BAYER AG, GERMANY).

Support

The support for the thermosensitive element according to the present invention may be transparent or translucent and is a thin flexible carrier made of transparent resin film, e.g. made of a cellulose ester, cellulose triacetate, polypropylene, polycarbonate or polyester, e.g. polyethylene terephthalate.

The support may be in sheet, ribbon or web form and subbed if need be to improve the adherence to the thermosensitive element coated thereon. It may be pigmented with a blue pigment as so-called blue-base. One or more backing layers may be provided to control physical properties such as curl and static.

Protective Layer

According to a preferred embodiment of the recording material, according to the present invention, the thermosensitive element is provided with a protective layer to avoid local deformation of the thermosensitive element and to improve resistance against abrasion.

The protective layer preferably comprises a binder, which may be solvent-soluble, solvent-dispersible, water-soluble or water-dispersible. Among the solvent-soluble binders polycarbonates as described in EP-A 614 769 are particularly preferred. However, water-soluble or water-dispersible binders are preferred for the protective layer, as coating can be performed from an aqueous composition and mixing of the protective layer with the immediate underlayer can be avoided by using a solvent-soluble or solvent-dispersible binder in the immediate underlayer.

The protective layer according to the present invention may be crosslinked. Crosslinking can be achieved by using crosslinking agents such as described in WO 95/12495.

Solid or liquid lubricants or combinations thereof are suitable for improving the slip characteristics of the thermographic recording materials according to the present invention. Preferred solid lubricants are thermomeltable particles such as those described in WO 94/11199.

The protective layer of the thermographic recording material according to the present invention may comprise a matting agent. Preferred matting agents are described in WO 94/11198, e.g. talc particles, and optionally protrude from the protective layer.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic Processing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

During thermal development of substantially light-insensitive thermographic materials the organic silver salt is converted into an amorphous phase only part of which is converted into elemental silver particles. After thermal development the non-converted organic silver salt may be present in one or more of the following states: an amorphous state, in the same crystalline state as that prior to thermal development and in one or more new crystalline states. Such new crystalline states may include one or more states which are preceded by an amorphous phase as the organic silver salt is heated up or cooled down.

An example of such behaviour is that of silver behenate for which three phases have been identified by X-ray diffraction measurements with a copper $K\alpha_1$ X-ray source. In the case of pure silver behenate, the well-known phase, which will be referred to as phase I, is observed up to temperatures of 120 to 130° C. at which amorphous silver behenate begins to be formed; a second crystalline phase is observed at temperatures between ca. 138° C. and ca. 156° C., which will be referred to as phase II, and upon heating silver behenate is preceded by an amorphous phase; and a third crystalline phase is observed at temperatures between ca. 156° C. and ca. 180° C., and upon heating silver behenate is also preceded by an amorphous phase. The X-ray diffaction peaks observed with phase II and phase III silver behenate are significantly broader than those observed for phase I silver behenate. The Bragg 2Θ angles of phases I, II and III silver behenate are summarized in table 1 below:

TABLE 1

| Silver behenate phase | Stability temperature range for pure silver behenate [° C.] | Bragg angles 2Θ of silver behenate phase upon irradiation with a copper $K\alpha_1$ X-ray source |
|---|---|---|
| Phase I | below ca. 135° C. | 4.53°, 6.01°, 7.56°, 9.12°, 10.66°, 12.12°, 13.62° |
| Phase II | ca. 135 to ca. 156° C. | 5.34–5.67°, 6.24°, 7.77°, 8.30–8.45°, 9.37°, 10.92° |
| Phase III | ca. 155 to ca. 180° C. | 4.76–4.81°, 5.9–6.18°#, 6.76–7.02°, 8.29°, 9.06° |

In the substantially light-insensitive thermographic materials according to the present invention containing at least one stabilizer according to formula I amorphization and elemental silver formation begins at lower temperatures. For example when the substantially light-insensitive organic silver salt of the thermosensitive element of the thermographic recording material of the present invention comprises silver behenate (AgB), the results shown in table 2 were obtained as a function of temperature. The formation of Ag° is clearly promoted at temperatures between 100 and 150° C. by the presence of glutaric acid (I-1) rather than adipic acid (D02), representing prior art materials, and the addition of glutaric acid to silver behenate with R02 results in a much more rapid disappearance of phase I silver behenate.

TABLE 2

| From XRD# measurements | [Ag° formed (I-1 + R02)]/[Ag° formed (D02 + R02)] | [quantity phase I AgB (I-1 + R02)]/[quantity phase I AgB (R02)] |
|---|---|---|
| at 25° C. | — | 9200/17100* |
| at 100° C. | 10.8 | 7500/10600 |
| at 110° C. | 13.3 | 1300/10000 |
| at 120° C. | 10.9 | 200/7400 |
| at 130° C. | 5.6 | 0/600 |
| at 140° C. | 2.6 | — |
| at 150° C. | 1.5 | — |

#irradiation with a copper $K\alpha_1$ X-ray source
*no difference in quantity of AgB, crystallinity influenced by additives When the substantially light-insensitive organic silver salt of the thermosensitive element of the thermographic recording material of the present invention comprises silver behenate, silver behenate is present subsequent to thermal development partly as an amorphous phase, as phase III and depending upon the composition also as phase I. Certain compounds including certain stabilizers according to formula I, e.g. glutaric acid, and the toning agent T02 (7-(ethylcarbonato)-benzo[e] [1,3]oxazine-2,4-dione) surprisingly have been found to stabilize phase III silver behenate at room temperature.

Moreover, with thermographic recording materials of the present invention in which the substantially light-insensitive organic silver salt comprises silver behenate a reddish change in the image tone from a blue-black tone to a more brownish tone may take place subsequent to thermal development, particularly if the thermal development time is reduced below 12 ms. X-ray diffraction measurements in real time have shown that this change in image tone subsequent to thermal development is accompanied by changes in the phase structure of the silver behenate. For example in materials using glutaric acid and R01, R02, R04 or R05 as the reducing agent, amorphous silver behenate is converted into phase I and phase III silver behenate in the first 15 minutes after thermal development. However, the use of glutaric acid together with R03 as the reducing agent (3,4-dihydroxybenzo-nitrile) in the thermographic recording material of the present invention considerably reduces this effect and phase III silver behenate is principally observed with very little phase I silver behenate.

It is preferred that two minutes after step (ii) of the above-mentioned recording process the silver behenate is partly present as phase II, with an X-ray diffraction spectrum upon irradiation with a copper $K\alpha_1$ X-ray source with Bragg angles 2Θ of 5.34–5.67°, 6.24°,7.77°, 8.30–8.45°, 9.37°, 10.92°, and/or phase III silver behenate, with an X-ray diffraction spectrum upon irradiation with a copper $K\alpha_1$ X-ray source with Bragg angles 2Θ of 4.76–4.81°, 5.9–6.18°, 6.76–7.02°, 8.29°, 9.06°, which is stable at room temperature.

Image-wise heating of the recording material can also be carried out using an electrically resistive ribbon incorporated into the material. Image- or pattern-wise heating of the recording material may also proceed by means of pixel-wise modulated ultra-sound.

INDUSTRIAL APPLICATION

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated. The ingredients used in the invention and comparative examples, are:

organic silver salts:

AgB=silver behenate;

the organic reducing agent:

R01=n-butyl 3,4-dihydroxybenzoate;
R02=ethyl 3,4-dihydroxybenzoate;
R03=3,4-dihydroxybenzonitrile;
R04=3,4-dihydroxyacetophenone;
R05=3,4-dihydroxybenzophenone;

the non-formula (I) dicarboxylic acids:
D01=pimelic acid;
D02=adipic acid;
D03=malonic acid;
D04=oxalic acid;
D05=maleic acid;
D06=1,2-phenylene-diacetic acid;

binders:
PVB=S-LEC BL5-HPZ, a polyvinyl butyral from SEKISUI Chemical Co. Ltd;

the antifoggants:
S01=tetrachlorophthalic acid anhydride;
S02=benzotriazole; and compounds with formula (I):
I-1=glutaric acid;
I-2=itaconic acid;
I-3=succinic acid;
I-4=2,2-dimethyl-glutaric acid;
I-5=tetrahydrofuran-2,3,4,5-tetracarboxylic acid;
I-6=3-methylglutaric acid;

the toning agents:
T01=benzo[e] [1,3]oxazine-2,4-dione;
T02=7-(ethylcarbonato)-benzo[e] [1,3]oxazine-2,4-dione;

the silicone oil:
Oil=BAYSILON™ MA, a polydimethylsiloxane from BAYER;

Comparative Examples 1 and 2 and Invention Example 1

Comparison of Image Tone of Thermographic Materials According to EP-A 687 572 With Those According to Present Invention The thermographic recording materials of COMPARATIVE EXAMPLES 1 and 2 (=EXAMPLE C3 of EP-A 687 572) and INVENTION EXAMPLE 1 were produced by doctor blade-coating a subbed 175 μm thick non-pigmented polyethylene terephthalate support with a composition containing 2-butanone as solvent/dispersing medium so as to obtain thereon, after drying, the thermosensitive elements of COMPARATIVE EXAMPLE 1 and INVENTION EXAMPLES 1 and 2 with the compositions given in Table 3:

TABLE 3

| | AgB | PVB | Stabilizer of formula (I) | | Non-formula (I) dicarboxylic acid | | T01 | Oil | Reducing agent | |
|---|---|---|---|---|---|---|---|---|---|---|
| | g/m² | g/m² | Type | g/m² | type | g/m² | g/m² | mg/m² | type | g/m² |
| Comparative example nr | | | | | | | | | | |
| 1 | 3.29 | 13.16 | — | — | D01 | 0.321 | 0.241 | 14.6 | R01 | 0.775 |
| 2 | 3.24 | 12.96 | — | — | D02 | 0.267 | 0.238 | 14.4 | R01 | 0.763 |
| Invention example nr | | | | | | | | | | |
| 1 | 3.21 | 12.84 | I-1 | 0.249 | — | — | 0.235 | 14.3 | R01 | 0.756 |

Thermographic Printing

During the thermographic printing of the substantially light-insensitive thermographic recording materials of COMPARATIVE EXAMPLES 1 and 2 and INVENTION EXAMPLE 1, the print head was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving a ribbon with a total thickness of 6 μm.

The DRYSTAR® 2000 printer from AGFA-GEVAERT was equipped with a thin film thermal head with a resolution of 300 dpi and was operated with a line time of 19 ms (the line time being the time needed for printing one line). During this line time the print head received constant power. The printing power was 65.8mW and the thermal head resistors were time-modulated to produce different image densities.

The maximum densities of the images ($D_{max}$) measured through a visible filter with a MACBETH™ TR924 densitometer in the grey scale step corresponding to a data level of 64 are given in Table 4.

Image Evaluation

The image tone of fresh prints made with the substantially light-insensitive thermographic recording materials of COMPARATIVE EXAMPLES 1 and 2 and INVENTION EXAMPLE 1 was assessed on the basis of the L*, a* and b* CIELAB-values as described above. The b* CIELAB-values of fresh prints of the substantially light-insensitive thermographic recording materials of COMPARATIVE EXAMPLES 1 and 2 and INVENTION EXAMPLE 1 at an optical density, D, of 1.0 measured at least 24 hours after printing (i.e. after stabilization of the image tone) are also given in Table 4.

TABLE 4

| | AgB | Stabilizer of formula (I) | | Non-formula (I) dicarboxylic acid | | | CIELAB b*-values | visual |
|---|---|---|---|---|---|---|---|---|
| | g/m² | type | g/m² | type | g/m² | $D_{max}$ (vis) | for D = 1.0 | colour |
| Comparative example nr. | | | | | | | | |
| 1 | 3.29 | — | — | D01 | 0.321 | 2.71 | 2.24 | brown–green |
| 2 | 3.24 | — | — | D02 | 0.267 | 2.54 | 1.36 | qreen |
| Invention example nr | | | | | | | | |
| 1 | 3.21 | I-1 | 0.249 | — | — | 2.59 | −4.16 | blue |

The image tone of the thermographic recording material of INVENTION EXAMPLE 1 is clearly bluer than that of the thermographic recording materials of COMPARATIVE EXAMPLES 1 and 2, without loss in image density.

Colour neutrality on the basis of CIELAB-values corresponds to a b* value of zero, with a negative b*-value indicating an increasingly bluer image-tone as b* becomes more negative and a positive b*-value indicating a yellowish image-tone becoming more ow as b* becomes more positive.

In terms of the visual perception of an image as a whole, the image tone of elements of the image with a density of 1.0 have a stronger effect than the image tone of elements with lower or higher optical. It is clear from the results of table 4 that the print produced with the thermographic recording material of INVENTION EXAMPLE 1 surprisingly has a substantially bluer tone, i.e. having a b*-value<0, than the prints produced with the thermographic recording materials of COMPARATIVE EXAMPLES 1 and 2, which have b*-values>0. This demonstrates the surprising improvement in image tone of the present invention over the invention of EP-A 687 572.

Comparative Examples 3 to 8 and Invention Examples 2 to 7

Image Tone of Thermographic Materials According to EP-A 687 572 Compared With That of Thermographic Materials of Present Invention The thermographic recording materials of COMPARATIVE EXAMPLES 3 to 8 according to the invention of EP-A 687 572 and INVENTION EXAMPLES 2 to 7 were produced by doctor blade-coating a subbed 175 μm thick non-pigmented polyethylene terephthalate support with a composition containing 2-butanone as solvent/dispersing medium so as to obtain thereon, after drying, the thermosensitive elements of COMPARATIVE EXAMPLES 3 to 8 and INVENTION EXAMPLES 2 to 7 with the compositions given in Table 5:

TABLE 5

| | AgB | PVB | Stabilizer of formula (I) | | Non-formula (I) dicarboxylic acid | | T01 | T02 | Oil | Reducing agent | | S01 | S02 |
|---|---|---|---|---|---|---|---|---|---|---|---|---|---|
| | g/m² | g/m² | type | G/m² | type | g/m² | g/m² | g/m² | mg/m² | type | g/m² | g/m² | g/m² |
| Comparative example nr. | | | | | | | | | | | | | |
| 3 | 7.41 | 29.7 | — | — | D01 | 0.716 | 0.403 | 0.208 | 65.8 | R02 | 1.493 | 0.234 | 0.194 |
| 4 | 4.27 | 17.08 | — | — | D02 | 0.354 | 0.232 | 0.120 | 37.9 | R02 | 0.861 | 0.112 | 0.137 |
| 5 | 4.1 | 12.3 | — | — | D02 | 0.331 | 0.223 | 0.115 | 36.0 | R02 | 0.827 | 0.130 | 0.108 |
| 6 | 4.3 | 17.2 | — | — | D03 | 0.254 | 0.234 | 0.120 | 38.2 | R02 | 0.867 | 0.136 | 0.113 |
| 7 | 4.1 | 12.3 | — | — | D04 | 0.204 | 0.223 | 0.115 | 36.0 | R02 | 0.827 | 0.130 | 0.108 |
| 8 | 4.1 | 12.3 | — | — | D05 | 0.263 | 0.223 | 0.115 | 36.0 | R02 | 0.827 | 0.130 | 0.108 |
| Invention example nr. | | | | | | | | | | | | | |
| 2 | 3.77 | 15.06 | I-1 | 0.294 | — | — | 0.205 | 0.106 | 33.5 | R02 | 0.760 | 0.119 | 0.099 |
| 3 | 3.80 | 15.20 | I-1 | 0.273 | — | — | 0.207 | 0.107 | 33.8 | R02 | 0.766 | 0.120 | 0.100 |
| 4 | 5.41 | 21.67 | I-1 | 0.422 | — | — | 0.357 | 0.089 | 48.1 | R02 | 1.091 | 0.171 | 0.142 |
| 5 | 3.87 | 15.48 | I-1<br>I-3 | 0.061<br>0.179 | — | — | 0.211 | 0.108 | 34.4 | R02 | 0.780 | 0.122 | 0.101 |
| 6 | 3.98 | 15.92 | I-2 | 0.127 | D02 | 0.171 | 0.217 | 0.111 | 35.4 | R02 | 0.802 | 0.126 | 0.104 |
| 7 | 3.95 | 15.8 | I-3 | 0.265 | — | — | 0.215 | 0.111 | 35.1 | R02 | 0.796 | 0.125 | 0.104 |

Thermographic evaluation and image evaluation were carried out as described for COMPARATIVE EXAMPLES 1 and 2 and INVENTION EXAMPLE 1 and the results are summarized in Table 6.

TABLE 6

| | AgB | Stabilizer of formula (I) | | Non-formula (I) dicarboxylic acid | | T01 mol % vs | T02 mol % vs | $D_{max}$ (vis- | CIELAB b*-values |
|---|---|---|---|---|---|---|---|---|---|
| | g/m² | type | g/m² | type | g/m² | AgB | AgB | ible) | for D = 1.0 |
| Comparative example nr. | | | | | | | | | |
| 3 | 7.41 | — | — | D01 | 0.716 | 14.93 | 4.99 | 2.7 | 2.8 |
| 4 | 4.27 | — | — | D02 | 0.354 | 14.93 | 4.99 | 2.3 | 3.7 |
| 5 | 4.1 | — | — | D02 | 0.331 | 14.93 | 4.99 | 3.3 | 3.1 |
| 6 | 4.3 | — | — | D03 | 0.254 | 14.93 | 4.99 | 1.7 | 3.4 |
| 7 | 4.1 | — | — | D04 | 0.204 | 14.93 | 4.99 | 2.75 | >10 |
| 8 | 4.1 | — | — | D05 | 0.263 | 14.93 | 4.99 | 2.7 | 6.2 |
| Invention example nr. | | | | | | | | | |
| 2 | 3.77 | I-1 | 0.294 | — | — | 14.93 | 4.99 | 2.5 | −6.5 |
| 3 | 3.80 | I-1 | 0.273 | — | — | 14.93 | 4.99 | 2.4 | −4.0 |
| 4 | 5.41 | I-1 | 0.422 | — | — | 18.1 | 2.93 | 2.9 | −5.2 |
| 5 | 3.87 | I-1 | 0.061 | — | — | 14.93 | 4.99 | 2.4 | −1.0 |
| | | I-3 | 0.179 | | | | | | |
| 6 | 3.98 | I-2 | 0.127 | D02 | 0.171 | 14.93 | 4.99 | 2.6 | −3.7 |
| 7 | 3.95 | I-3 | 0.265 | — | — | 14.93 | 4.99 | 2.4 | −0.3 |

Colour neutrality on the basis of CIELAB-values corresponds to a ue of zero, with a negative b*-value indicating an increasingly bluer image-tone as b* becomes more negative and a positive b*-value indicating a yellowish image-tone becoming more yellow as b* becomes more positive.

In terms of the visual perception of an image as a whole, the image tone of elements of the image with a density of 1.0 have a stronger effect than the image tone of elements with lower or higher optical. It is clear from the results of table 6 that the print produced with the thermographic recording materials of INVENTION EXAMPLES 2 to 7 have a substantially bluer tone, i.e. having a b*-value<0, than the prints produced with the thermographic recording materials of COMPARATIVE EXAMPLES 3 to 6 and 8 according to the invention of EP-A 687 572 and COMPARATIVE EXAMPLE 7 with oxalic acid, which have b*-values>0. This demonstrates the surprising improvement in image tone of the present invention over the invention of EP-A 687 572.

Invention Examples 8 to 11 and Comparative Example 9

The thermographic recording materials of INVENTION EXAMPLES 8 to 11 and COMPARATIVE EXAMPLE 9 were produced by doctor blade-coating a subbed 175 μm thick non-pigmented polyethylene terephthalate support with a composition containing 2-butanone as solvent/dispersing medium so as to obtain thereon, after drying, the thermosensitive elements of INVENTION EXAMPLES 8 to 11 and COMPARATIVE EXAMPLE 9 with the compositions given in Table 7.

TABLE 7

| | AgB | PVB | Stabilizer of formula (I) | | Non-formula (I) dicarboxylic acid | | T01 | T02 | Oil | Reducing agent | | S01 | S02 |
|---|---|---|---|---|---|---|---|---|---|---|---|---|---|
| | g/m² | g/m² | type | g/m² | type | g/m² | g/m² | g/m² | mg/m² | type | g/m² | g/m² | g/m² |
| Comparative example nr. | | | | | | | | | | | | | |
| 9 | 3.82 | 15.28 | — | — | D06 | 0.401 | 0.210 | 0.105 | 34 | R02 | 0.770 | 0.120 | 0.100 |
| Invention example nr | | | | | | | | | | | | | |
| 8 | 3.82 | 15.28 | I-1 | 0.273 | — | — | 0.210 | 0.105 | 34 | R02 | 0.770 | 0.120 | 0.100 |
| 9 | 3.82 | 15.28 | I-4 | 0.331 | — | — | 0.210 | 0.105 | 34 | R02 | 0.770 | 0.120 | 0.100 |
| 10 | 3.82 | 15.28 | I-5 | 0.513 | — | — | 0.210 | 0.105 | 34 | R02 | 0.770 | 0.120 | 0.100 |
| 11 | 3.82 | 15.28 | I-6 | 0.302 | — | — | 0.210 | 0.105 | 34 | R02 | 0.770 | 0.120 | 0.100 |

Thermographic evaluation and image evaluation were carried out as described for COMPARATIVE EXAMPLES 1 and 2 and INVENTION EXAMPLE 1 and the results are summarized in Table 8.

Colour neutrality on the basis of CIELAB-values corresponds to a b* value of zero, with a negative b*-value indicating an increasingly bluer image-tone as b* becomes more negative and a positive b*-value indicating a yellowish image-tone becoming more yellow as b* becomes more positive.

In terms of the visual perception of an image as a whole, the image tone of elements of the image with a density of 1.0 have a stronger effect than the image tone of elements with lower or higher optical. It is clear from the results of table 8 that the print produced with the thermographic recording materials of INVENTION EXAMPLES 8 to 11 have a substantially bluer tone, i.e. having a b*-value<0, than the prints produced with the thermographic recording materials of COMPARATIVE EXAMPLES 9 according to the invention of EP-A 687 572, which has a b*-value>0. This demonstrates the surprising improvement in image tone of the present invention over the invention of EP-A 687 572.

TABLE 8

| | AgB | Stabilizer of formula (I) | | Non-formula (I) dicarboxylic acid | | T01 mol % vs | T02 mol % vs | CIELAB b*-values |
|---|---|---|---|---|---|---|---|---|
| | g/m² | Type | g/m² | Type | g/m² | AgB | AgB | for D = 1.0 |
| Comparative example nr. | | | | | | | | |
| 9 | 3.82 | — | — | D06 | 0.401 | 14.93 | 4.99 | 3.41 |
| Invention example nr. | | | | | | | | |
| 8 | 3.82 | I-1 | 0.273 | — | — | 14.93 | 4.99 | −4.27 |
| 9 | 3.82 | I-4 | 0.331 | — | — | 14.93 | 4.99 | −1.3 |
| 10 | 3.82 | I-5 | 0.513 | — | — | 14.93 | 4.99 | −0.23 |
| 11 | 3.82 | I-6 | 0.302 | — | — | 14.93 | 4.99 | −2.74 |

Invention Examples 13 and 14

The thermographic recording materials of INVENTION EXAMPLES 13 and 14 were produced by doctor blade-coating a subbed 175 μm thick non-pigmented polyethylene terephthalate support and a subbed 175 μm thick blue-pigmented polyethylene terephthalate support (MEDICAL IMAGING MATERIAL SUPPORT 4 with a*=−7.92; b*=−16.62; Dvis=0.181) respectively with the same composition containing 2-butanone as solvent/dispersing medium so as to obtain thereon, after drying, the thermosensitive elements of INVENTION EXAMPLES 13 and 14 with the compositions given in Table 9:

TABLE 9

| Invention example | AgB | PVB | Stabilizer of formula (I) | | T01 | T02 | Oil | Reducing agent | | S01 | S02 |
|---|---|---|---|---|---|---|---|---|---|---|---|
| nr. | g/m² | g/m² | type | g/m² | g/m² | g/m² | mg/m² | type | g/m² | g/m² | g/m² |
| 12 | 4.84 | 19.3 | I-1 | 0.38 | 0.26 | 0.14 | 43 | R02 | 0.98 | 0.15 | 0.13 |
| 13 | 4.84 | 19.3 | I-1 | 0.38 | 0.26 | 0.14 | 43 | R02 | 0.98 | 0.15 | 0.13 |

Thermographic evaluation and image evaluation were carried out as described for COMPARATIVE EXAMPLES 1 and 2 and INVENTION EXAMPLE 1 except that the CIELAB a values were also determined. The results are summarized in Table 10.

TABLE 10

| Invention example | AgB | Stabilizer of formula (I) | | T01 mol % | T02 mol % | CIELAB a*-values | CIELAB b*-values |
|---|---|---|---|---|---|---|---|
| nr. | g/m² | Type | g/m² | vs AgB | vs AgB | for D = 1.0 | for D = 1.0 |
| 12 | 4.84 | I-1 | 0.38 | 14.93 | −4.3 | 0.0 | −4.3 |
| 13 | 4.84 | I-1 | 0.38 | 14.93 | −12.6 | −2.9 | −12.6 |

It is clear from the results of table 10 that the print produced with the thermographic recording material of INVENTION EXAMPLE 12 has a blue tone at D=1.0, i.e. having a b*-value<0. The b* value of the print produced with the thermographic recording material of INVENTION EXAMPLE 13 having the same composition as the thermographic recording material of INVENTION EXAMPLE 12 merely shows the effect of using the MEDICAL IMAGING SUPPORT 4, blue-pigmented polyethylene terephthalate support, rather than a non-pigmented polyethylene terephthalate support. As to be expected in view of the b*-value of the support of −16.62, the b*-value at D=1.0 is substantially lower with a value of −12.6 and as to be expected from the a*-value of the support of −7.92 the a*-value at D=1.0 is also substantially lower with a value of −2.9.

Invention Examples 14 to 17

The thermographic recording materials of INVENTION EXAMPLES 14 to 17 were produced by doctor blade-coating a subbed 175 μm thick blue-pigmented polyethylene terephthalate support (MEDICAL IMAGING MATERIAL SUPPORT 4 with a*=−7.92; b*=−16.62; Dvis =0.181) with a composition containing 2-butanone as solvent/dispersing medium, so as to obtain thereon, after drying, the thermosensitive elements of INVENTION EXAMPLES 14 to 17 with the compositions given in Table 11:

TABLE 11

| Invention example | AgB | PVB | Stabilizer of formula (I) | | T01 | T02 | Oil | Reducing agent | | S01 | S02 |
|---|---|---|---|---|---|---|---|---|---|---|---|
| nr. | g/m² | g/m² | type | g/m² | g/m² | g/m² | mg/m² | type | g/m² | g/m² | g/m² |
| 14 | 3.70 | 14.9 | I-1 | 0.26 | 0.203 | 0.105 | 33 | R02 | 0.75 | 0.12 | 0.10 |
| 15 | 3.70 | 14.9 | I-1 | 0.26 | 0.203 | 0.105 | 33 | R03 | 0.56 | 0.12 | 0.10 |
| 16 | 3.70 | 14.9 | I-1 | 0.26 | 0.203 | 0.105 | 33 | R04 | 0.63 | 0.12 | 0.10 |
| 17 | 3.70 | 14.9 | I-1 | 0.26 | 0.203 | 0.105 | 33 | R05 | 0.88 | 0.12 | 0.10 |

Thermographic evaluation and image evaluation were carried out as described for COMPARATIVE EXAMPLES 1 and 2 and INVENTION EXAMPLE 1 except that the CIELAB a* values were also determined and that the line time of the printer was reduced. The results obtained at line times of 11.8, 7.0 and 4.5 ms (corresponding to 90mW/pixel, 99 mW/pixel and 108 mw/pixel respectively) are summarized for b*-values at D=1.0 and a*-values at D=1.0 determined 5 minutes and 24 hours after printing in Tables 12 and 13 respectively. After 24 hours the image tone of the prints does not change any further and hence the b* and a* values measured after 24 hours represent their equilibrium values.

TABLE 12

| Invention example | AgB | Stabilizer of formula (I) | | T01 mol % vs | T02 mol % vs | $D_{max}$ | CIELAB b*-values for D = 1.0 | | |
|---|---|---|---|---|---|---|---|---|---|
| nr. | g/m² | type | g/m² | AgB | AgB | (visible) | t = 5 min | t = 24 h | Δb* |
| | | | | LINE TIME = 11.8 ms | | | | | |
| 14 | 3.70 | I-1 | 0.26 | 14.93 | 4.99 | 2.84 | −13.7 | −12.8 | +0.9 |
| 15 | 3.70 | I-1 | 0.26 | 14.93 | 4.99 | 2.25 | −8.1 | −7.2 | +0.9 |
| 16 | 3.70 | I-1 | 0.26 | 14.93 | 4.99 | 2.93 | −12.7 | −12.1 | +0.6 |
| 17 | 3.70 | I-1 | 0.26 | 14.93 | 4.99 | 2.97 | −12.2 | −11.7 | +0.5 |
| | | | | LINE TIME = 7.0 ms | | | | | |
| 14 | 3.70 | I-1 | 0.26 | 14.93 | 4.99 | 2.71 | −13.7 | −13.9 | +0.2 |
| 15 | 3.70 | I-1 | 0.26 | 14.93 | 4.99 | 2.12 | −9.3 | −8.6 | +0.7 |
| 16 | 3.70 | I-1 | 0.26 | 14.93 | 4.99 | 2.89 | −14.1 | −13.6 | +0.5 |
| 17 | 3.70 | I-1 | 0.26 | 14.93 | 4.99 | 2.83 | −13.2 | −13.0 | +0.2 |
| | | | | LINE TIME = 4.5 ms | | | | | |
| 14 | 3.70 | I-1 | 0.26 | 14.93 | 4.99 | 1.82 | −15.8 | −12.7 | +3.1 |
| 15 | 3.70 | I-1 | 0.26 | 14.93 | 4.99 | 1.48 | −10.2 | −9.2 | +1.0 |
| 16 | 3.70 | I-1 | 0.26 | 14.93 | 4.99 | 2.03 | −15.8 | −14.1 | +1.7 |
| 17 | 3.70 | I-1 | 0.26 | 14.93 | 4.99 | 1.95 | −14.4 | −12.6 | +1.8 |

Table 12 shows that a drift in b* for D=1.0 takes place between 5 minutes and 24 hours after printing. This drift is between +0.5 and +0.9 for a line time of 11.8 ms; +0.2 and +0.7 for a line time of 7.0 ms; and +1.0 to +3.1 for a line time of 4.5 ms. The drifts of the thermographic recording materials of INVENTION EXAMPLES 14, 15, 16 and 17 are acceptable for line times of 11.8 and 7.0 ms, but it is desirable to reduce the line time to 4.5 ms so that the throughput can be optimized. In the case of a 4.5 ms line time, however, the drift in b* is only acceptable in the case of the thermographic recording material of INVENTION EXAMPLE 15 containing glutaric acid as the stabilizer compound according to formula I together with the reducing agent R03 (3,4-dihydroxybenzonitrile).

TABLE 13

| Invention example | AgB | Stabilizer of formula (I) | | T01 mol % vs | T02 mol % vs | $D_{max}$ | CIELAB a*-values for D = 1.0 | | |
|---|---|---|---|---|---|---|---|---|---|
| nr. | g/m² | type | g/m² | AgB | AgB | (visible) | t = 5 min | t = 24 h | Δa* |
| | | | | LINE TIME = 11.8 ms | | | | | |
| 14 | 3.70 | I-1 | 0.26 | 14.93 | 4.99 | 2.84 | −2.4 | −2.0 | +0.4 |
| 15 | 3.70 | I-1 | 0.26 | 14.93 | 4.99 | 2.25 | −4.8 | −4.8 | 0.0 |
| 16 | 3.70 | I-1 | 0.26 | 14.93 | 4.99 | 2.93 | −3.3 | −3.2 | +0.1 |
| 17 | 3.70 | I-1 | 0.26 | 14.93 | 4.99 | 2.97 | −2.7 | −2.4 | +0.3 |
| | | | | LINE TIME = 7.0 ms | | | | | |
| 14 | 3.70 | I-1 | 0.26 | 14.93 | 4.99 | 2.71 | 0.6 | 1.1 | +0.5 |
| 15 | 3.70 | I-1 | 0.26 | 14.93 | 4.99 | 2.12 | −3.9 | −4.2 | −0.3 |

TABLE 13-continued

| Invention example | AgB | Stabilizer of formula (I) | | T01 mol % vs | T02 mol % vs | $D_{max}$ | CIELAB a*-values for D = 1.0 | | |
|---|---|---|---|---|---|---|---|---|---|
| nr. | g/m² | type | g/m² | AgB | AgB | (visible) | t = 5 min | t = 24 h | Δa* |
| 16 | 3.70 | I-1 | 0.26 | 14.93 | 4.99 | 2.89 | −1.0 | −0.9 | +0.1 |
| 17 | 3.70 | I-1 | 0.26 | 14.93 | 4.99 | 2.83 | 0.6 | −0.1 | −0.7 |
| | | | | LINE TIME = 4.5 ms | | | | | |
| 14 | 3.70 | I-1 | 0.26 | 14.93 | 4.99 | 1.82 | 5.2 | 7.6 | +2.4 |
| 15 | 3.70 | I-1 | 0.26 | 14.93 | 4.99 | 1.48 | −1.6 | −0.9 | +0.7 |
| 16 | 3.70 | I-1 | 0.26 | 14.93 | 4.99 | 2.03 | 3.3 | 5.0 | +1.7 |
| 17 | 3.70 | I-1 | 0.26 | 14.93 | 4.99 | 1.95 | 5.3 | 6.8 | +1.5 |

Table 13 shows that a drift in a* for D=1.0 takes place between 5 minutes and 24 hours after printing. This drift is between 0.0 and +0.4 for a line time of 11.8 ms; −0.7 and +0.5 for a line time of 7.0 ms; and +0.7 to +2.4 for a line time of 4.5 ms. The drifts of the thermographic recording materials of INVENTION EXAMPLES 14, 15, 16 and 17 are acceptable for line times of 11.8 and 7.0 ms, but it is desirable to reduce the line time to 4.5 ms so that the throughput can be optimized. However, in the case of a 4.5 ms line time the drift in a is only acceptable in the case of the thermographic recording material of INVENTION EXAMPLE 15 containing glutaric acid as the stabilizer compound according to formula I together with the reducing agent R03 (3,4-dihydroxybenzonitrile).

In addition to drift in b* and a*, reduction in line time also resulted in shifts in the b*(24 h) and a*(24 h) values, see Table 14.

TABLE 14

| Invention example nr. | b* (24h) - shift upon line time reduction from 11.8 to 7 ms | b* (24h) - shift upon line time reduction from 11.8 to 4.5 ms | a* (24h) - shift upon line time reduction from 11.8 to 7 ms | a* (24h) - shift upon line time reduction from 11.8 to 4.5 ms |
|---|---|---|---|---|
| 14 | −1.1 | +0.1 | +3.1 | +9.6 |
| 15 | −1.4 | −2.0 | +0.6 | +3.9 |
| 16 | −1.4 | −2.0 | +2.3 | +8.2 |
| 17 | −1.3 | −0.9 | +2.3 | +9.2 |

The shifts in b*(24 h) values upon line time reduction are quite small and fairly similar for the thermographic recording materials of INVENTION EXAMPLES 14, 15, 16 and 17. The shifts in a*(24 h) values upon line time reduction from 1.8 to 7.0 ms are also acceptable for all the thermographic recording materials of INVENTION EXAMPLES 14, 15, 16 and 17, but these materials exhibit significant differences upon further line time reduction to 4.5 ms with shifts varying between +3.9 for the thermographic recording material of INVENTION EXAMPLE 15 and +9.6 for the thermographic recording material of INVENTION EXAMPLE 14.

In conclusion the thermographic recording materials of INVENTION EXAMPLES 14, 15, 16 and 17 are all suitable for use with printers with line times of 11.8 and 7.0 ms as regards a* and b* drift, but only the thermographic recording material of INVENTION EXAMPLE 15 is suitable for use with a printer with a line time of 4.5 ms. If the shift in absolute image tone with decreasing line time is taken into account, the shift in b* values after 24 hours is fairly small and either negative or only slightly positive and hence is acceptable. However, whereas the shift in a* values after 24 hours is fairly small but positive upon line time reduction to 7.0 ms for acceptable for all the thermographic recording materials of INVENTION EXAMPLES 14, 15, 16 and 17, this is not the case upon further reduction in line time to 4.5 ms. For a line time of 4.5 ms, only the thermographic recording material of INVENTION EXAMPLE 15 has an acceptable shift in b* and a* values after 24 h.

Having described in detail preferred embodiments of the current invention, it will now be apparent to those skilled in the art that numerous modifications can be made therein without departing from the scope of the invention as defined in the following claims.

What is claimed is:

1. A substantially light-insensitive black and white thermographic recording material comprising a thermosensitive element and a support, the thermosensitive element containing at least one substantially light-insensitive organic silver salt, at least one organic reducing agent therefor in thermal working relationship therewith, a binder, at least one stabilizer and optionally an α,ω-alkyldicarboxylic acid with a straight chain alkyl group having at least 4 carbon atoms which may be substituted, however neither including 3,5-dihydroxybenzoic acid as acidic reagent nor di-tert-butyl-p-cresol as a sole organic reducing agent, wherein said at least one stabilizer is represented by formula (I):

$$R^1—(O{=}C)—R^2—(C{=}O)—R^3 \quad (I)$$

wherein $R^2$ is a divalent straight chain saturated hydrocarbon group with 2 or 3 carbon atoms which may be substituted with one or more of =O, =S, $=CR^4R^5$, an alkyl group, a cycloalkyl group, a hydroxy group, a thiol group, a $—(C{=}O)R^6$ group or two of said substituents of $R^2$ may together form a closed non-aromatic carbocyclic or heterocyclic ring; $R^4$ and $R^5$ are independently hydrogen or an alkyl, hydroxy, thiol, $—(C{=}O)R^7$ group or $R^4$ and $R^5$ together may form a closed carbocyclic or heterocyclic group; $R^1$ and $R^3$ are a hydroxy group or together form an oxygen atom of an anhydride group; $R^6$ and $R^7$ are independently a hydroxy or $—NHR^8$ group ; $R^8$ is hydrogen or a hydroxy, alkyl, aryl or $—SO_2R^9$ group; $R^9$ is an alkyl, cycloalkyl, heterocyclic, aryl, heteroaryl, an $—OR^{10}$, or a $—NR^{11}R^{12}$ group; $R^{10}$ and $R^{11}$ are independently an alkyl, cycloalkyl or aryl group; $R^{12}$ is hydrogen or an alkyl, cycloalkyl or aryl group; and $R^{11}$ and $R^{12}$ may together form a closed carbocyclic or heterocyclic group; and wherein the concentration of said at least one stablizer and said α,ω-alkyldicarboxylic acid, if present, is together at least 20 mol % with respect to said organic silver salts.

2. Thermographic recording material according to claim 1, wherein said at least one stabilizer according to formula (I) has a $pka_1$ in the range of 1.5 to 5.

3. Thermographic recording material according to claim 1, wherein said at least one stabilizer according to formula (I) is capable of forming an intramolecular anhydride.

4. Thermographic recording material according to claim 1, wherein said at least one stabilizer according to formula (I) is selected from the group consisting of glutaric acid, succinic acid, 2-methyl succinic acid, 2,2-dimethyl-glutaric acid, 3-methylglutaric acid, tetrahydrofuran-2,3,4,5-tetracarboxylic acid and itaconic acid.

5. Thermographic recording material according to claim 1, wherein said thermosensitive element further contains at least one toning agent and said at least one toning agent is selected from the group consisting of phthalazinone, a phthalazinone derivative, pyridazone, a pyridazone derivative, a benzoxazin derivative and a substituted benzoxazine derivative.

6. Thermographic recording material according to claim 5, wherein said at least one toning agent is selected from the group consisting of benzo[e] [1,3]oxazine-2,4-dione, 7-methylbenzo[e] [1,3]oxazine-2,4-dione and 7-(ethylcarbonato)benzo[e] [1,3]oxazine-2,4-dione.

7. Thermographic recording material according to claim 1, wherein said at least one organic reducing agent is selected from the group consisting of ethyl 3,4-dihydroxybenzoate, n-butyl 3,4-dihydroxybenzoate, 3,4-dihydroxybenzonitrile, 3,4-dihydroxy-acetophenone and 3,4-dihydroxy-benzophenone.

8. Thermographic recording material according to claim 7, wherein said at least one organic reducing agent comprises 3,4-dihydroxybenzonitrile in a concentration of at least 30 mol % with respect to said substantially light-insensitive organic silver salt.

9. Thermographic recording material according to claim 1, wherein said α,ω-alkyldicarboxylic acid is present and is selected from the group consisting of adipic acid, pimelic acid, suberic acid and azelaic acid.

10. Thermographic recording material according to claim 1, wherein said at least one substantially light-insensitive organic silver salt comprises silver behenate.

11. A recording process comprising the steps of:

(i) bringing an outermost layer of a substantially light-insensitive black and white thermographic recording material into proximity with a heat source, said thermographic recording material comprising a thermosensitive element and a support, the thermosensitive element containing at least one substantially light-insensitive organic silver salt, at least one organic reducing agent therefor in thermal working relationship therewith, a binder, at least one stabilizer and optionally an α,ω-alkyldicarboxylic acid with a straight chain alkyl group having at least 4 carbon atoms which may be substituted, however neither including 3,5-dihydroxybenzoic acid as acidic reagent nor di-tert-butyl-p-cresol as a sole organic reducing agent, wherein said at least one stabilizer is represented by formula (I):

$$R^1—(O=C)—R^2—(C=O)—R^3 \quad (I)$$

wherein $R^2$ is a divalent straight chain saturated hydrocarbon group with 2 or 3 carbon atoms which may be substituted with one or more of =O, =S, $=CR^4R^5$, an alkyl group, a cycloalkyl group, a hydroxy group, a thiol group, a $—(C=O)R^6$ group or two of said substituents of $R^2$ may together form a closed non-aromatic carbocyclic or heterocyclic ring; $R^4$ and $R^5$ are independently hydrogen or an alkyl, hydroxy, thiol, $—(C=O)R^7$ group or $R^4$ and $R^5$ together may form a closed carbocyclic or heterocyclic group; $R^1$, $R^3$, $R^6$ and $R^7$ are independently a hydroxy or $—NHR^8$ group or $R^1$ and $R^3$ together is an oxygen atom forming an anhydride group; $R^8$ is hydrogen or a hydroxy, alkyl, aryl or $—SO_2R^9$ group; $R^9$ is an alkyl, cycloalkyl, heterocyclic, aryl, heteroaryl, an $—OR^{10}$, or a $—NR^{11}—R^{12}$ group; $R^{10}$ and $R^{11}$ are independently an alkyl, cycloalkyl or aryl group; $R^{12}$ is hydrogen or an alkyl, cycloalkyl or aryl group; and $R^{11}$ and $R^{12}$ may together form a closed carbocyclic or heterocyclic group; and wherein the concentration of said at least one stablizer and said α,ω-alkyldicarboxylic acid, if present, is together at least 20 mol % with respect to said organic silver salts;

(ii) applying heat from said heat source imagewise to said thermographic recording material in a substantially water-free condition while maintaining proximity to said heat source to produce an image; and (iii) removing said thermographic recording material from said heat source.

12. Recording process according to claim 11, wherein said heat source is a thin film thermal head.

13. Recording process according to claim 11, wherein said thermographic recording material contains silver behenate and two minutes after step (ii) said silver behenate is partly present as phase II, with an X-ray diffraction spectrum upon irradiation with a copper $K\alpha_1$ X-ray source with Bragg angles 2Θ of 5.34–5.67°, 6.24°,7.77°, 8.30–8.45°, 9.37°, 10.92°, and/or phase III silver behenate, with an X-ray diffraction spectrum upon irradiation with a copper $K\alpha_1$ X-ray source with Bragg angles 2Θ of 4.76–4.81°, 5.9–6.18°, 6.76–7.02°, 8.29°, 9.06°, which is stable at room temperature.

* * * * *